US011715588B2

(12) United States Patent
Hjortstam et al.

(10) Patent No.: US 11,715,588 B2
(45) Date of Patent: Aug. 1, 2023

(54) INSULATOR HAVING INTERNAL COOLING CHANNELS

(71) Applicant: Hitachi Energy Switzerland AG, Baden (CH)

(72) Inventors: Olof Hjortstam, Västerås (SE); Mark Czernuschka, Rosenberg (DE); Orlando Girlanda, Västerås (SE)

(73) Assignee: Hitachi Energy Switzerland AG, Baden (CH)

( * ) Notice: Subject to any disclaimer, the term of this patent is extended or adjusted under 35 U.S.C. 154(b) by 0 days.

(21) Appl. No.: 17/911,799

(22) PCT Filed: Mar. 12, 2021

(86) PCT No.: PCT/EP2021/056379
§ 371 (c)(1),
(2) Date: Sep. 15, 2022

(87) PCT Pub. No.: WO2021/185699
PCT Pub. Date: Sep. 23, 2021

(65) Prior Publication Data

US 2023/0133073 A1 May 4, 2023

(30) Foreign Application Priority Data

Mar. 17, 2020 (EP) ..... 20163757

(51) Int. Cl.
*H01F 27/12* (2006.01)
*H01F 27/32* (2006.01)
*H01F 27/02* (2006.01)

(52) U.S. Cl.
CPC ..... *H01F 27/12* (2013.01); *H01F 27/322* (2013.01); *H01F 27/02* (2013.01)

(58) Field of Classification Search
CPC ..... H01F 27/12; H01F 27/322; H01F 27/02; H01F 27/00–40
See application file for complete search history.

(56) References Cited

U.S. PATENT DOCUMENTS 1,317,003 A 9/1919 Creighton
2,735,075 A * 2/1956 Thomason ..... H01F 27/303 336/185

(Continued)

FOREIGN PATENT DOCUMENTS

CN 202678030 U 1/2013
CN 103975399 A 8/2014

(Continued)

OTHER PUBLICATIONS

International Search Report and Written Opinion of the International Searching Authority, PCT/EP2021/056379, dated May 10, 2021, 15 pages.

(Continued)

*Primary Examiner* — Tuyen T Nguyen
(74) *Attorney, Agent, or Firm* — Sage Patent Group

(57) ABSTRACT

The present disclosure relates to an electrical insulator, for an inductive device filled with an electrically insulating cooling fluid. The insulator defines a plurality of internal channels for allowing the fluid to flow there through to improve circulation of the fluid within the inductive device.

20 Claims, 1 Drawing Sheet

(56) References Cited

U.S. PATENT DOCUMENTS

| | | | | | |
|---|---|---|---|---|---|
| 2,892,168 | A | * | 6/1959 | Seidel | H01F 37/005 336/197 |
| 4,308,512 | A | * | 12/1981 | Capecchiacci | H01F 41/04 336/60 |
| 5,444,426 | A | * | 8/1995 | Sokai | H01F 27/322 336/60 |
| 8,232,855 | B2 | | 7/2012 | El-Barbar et al. | |
| 9,947,453 | B2 | | 4/2018 | Ono et al. | |
| 2015/0213940 | A1 | | 7/2015 | Miyamoto et al. | |

FOREIGN PATENT DOCUMENTS

| | | | | | |
|---|---|---|---|---|---|
| CN | 108735440 | A | | 11/2018 | |
| CN | 209766194 | U | | 12/2019 | |
| CN | 209766197 | U | | 12/2019 | |
| DE | 2556215 | A1 | | 6/1976 | |
| EP | 2602800 | A1 | | 6/2013 | |
| EP | 2747097 | A1 | | 6/2014 | |
| EP | 3312856 | A1 | | 4/2018 | |
| GB | 2026779 | A | * | 2/1980 | H01F 21/12 |
| JP | 2015228442 | A | | 12/2015 | |
| WO | 2011124835 | A1 | | 10/2011 | |

OTHER PUBLICATIONS

International Preliminary Report on Patentability of the International Preliminary Examiner Authority, PCT/EP2021/056379, dated Jun. 8, 2022, 12 pages.

Extended European Search Report dated Sep. 20, 2022 for European Patent Application No. 20163757.6, 9 pages.

Chinese Office Action, CN Application No. 2021800208879, dated Mar. 12, 2021, 5 pages.

European Patent Office Action, EP Application No. 20163757.6, dated Feb. 17, 2023, 17 pages.

* cited by examiner

INSULATOR HAVING INTERNAL COOLING CHANNELS

CROSS REFERENCE TO RELATED APPLICATIONS

This application is a 35 U.S.C. § 371 national stage application of PCT International Application No. PCT/EP2021/056379 filed on Mar. 12, 2021, which in turn claims foreign priority to European Patent Application No. 20163757.6 filed on Mar. 17, 2020, the disclosures and content of which are incorporated by reference herein in their entirety.

TECHNICAL FIELD

The present disclosure relates to an electrical insulator for a fluid-filled inductive device.

BACKGROUND

A fluid-filled inductive device, e.g. a transformer, comprises solid insulation and cooling fluid. A sufficient circulation of the cooling fluid is needed for efficient cooling of the inductive device. Thus, the solid insulation should allow the cooling fluid to pass and circulate in the device. For example, the top and bottom winding insulators, so called winding tables or pressplates, may be comprised in arrangements of several separate but combined parts, i.e. pressplates and common spacer rings, to allow the cooling fluid to pass the solid insulation.

SUMMARY

It is an objective of the present disclosure to provide an improved electrical insulator for an inductive device 1 filled with an electrically insulating cooling fluid, for allowing the fluid to pass the insulator.

According to an aspect of the present disclosure, there is provided an electrical insulator. The insulator is configured to be used in an inductive device filled with an electrically insulating cooling fluid. The insulator defines a plurality of internal channels for allowing the electrically insulating cooling fluid to flow there through to improve circulation of the fluid within the inductive device.

According to an aspect of the present disclosure there is provided an electrical insulator, for an inductive device filled with an electrically insulating cooling fluid, the insulator defining a plurality of internal channels for allowing the fluid to flow there through to improve circulation of the fluid within the inductive device, wherein the insulator is flat and the channels comprise radial channels extending in a plane within the insulator which is parallel to opposing first and second main surfaces of the insulator, wherein the channels comprise axial channels, each of the axial channels extending through at least one of the first and second main surfaces and into at least one of the radial channels for allowing the cooling fluid to pass between the axial and radial channels and wherein the insulator is made of at least one electrically insulating material comprising a composite material of fibres, e.g. synthetic fibres such as glass fibres, in a resin matrix, e.g. comprising a curable resin such as an epoxy or polyester resin, preferably epoxy.

According to another aspect of the present disclosure, there is provided an inductive device comprising a housing, an electrically insulating cooling fluid contained within the housing, a winding arrangement submerged in the cooling fluid, and at least one insulator of the present disclosure.

By the insulator having internal channels for the cooling fluid, the circulation of the cooling fluid can be improved without the need for spacers or the like which would increase the spatial footprint of the insulator. The insulator, and thus the whole inductive device, may be made more compact.

It is to be noted that any feature of any of the aspects may be applied to any other aspect, wherever appropriate. Likewise, any advantage of any of the aspects may apply to any of the other aspects. Other objectives, features and advantages of the enclosed embodiments will be apparent from the following detailed disclosure, from the attached dependent claims as well as from the drawings.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated. The use of "first", "second" etc. for different features/components of the present disclosure are only intended to distinguish the features/components from other similar features/components and not to impart any order or hierarchy to the features/components.

BRIEF DESCRIPTION OF THE DRAWINGS

Embodiments will be described, by way of example, with reference to the accompanying drawings, in which.

DETAILED DESCRIPTION

Embodiments will now be described more fully hereinafter with reference to the accompanying drawings, in which certain embodiments are shown. However, other embodiments in many different forms are possible within the scope of the present disclosure. Rather, the following embodiments are provided by way of example so that this disclosure will be thorough and complete, and will fully convey the scope of the disclosure to those skilled in the art. Like numbers refer to like elements throughout the description.

Figure 1:
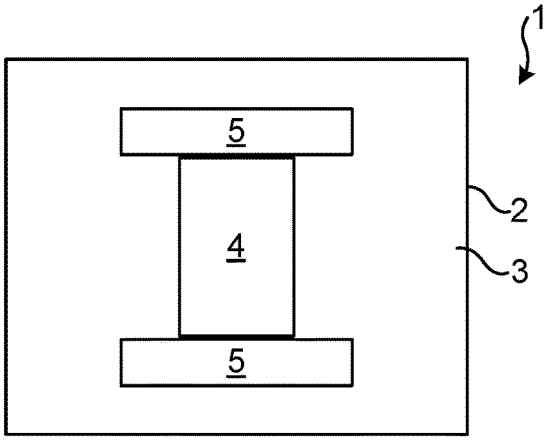
FIG. 1 is a schematic sectional side view of an inductive device, in accordance with some embodiments of the present disclosure.

FIG. 1 illustrates an inductive device 1, e.g. an electrical power transformer or reactor, typically a transformer. The device 1 comprises a conventional winding arrangement 4 of wound electrical conductor(s) in a housing 3, e.g. a transformer tank. The housing 2 is filled with an electrically insulating cooling fluid 3, e.g. a liquid or a gas, preferably a liquid such as a mineral oil or ester liquid, e.g. a transformer oil. The inductive device 1 comprises solid insulators 5, e.g. pressplates as illustrated in the figure. The winding 4 may be pressed between the pressplates 5 to stabilize the winding and separate it from e.g. a core or other elements in the inductive device. The insulators 5 of the present disclosure may additionally or alternatively to pressplates be used as any other solid insulation in an inductive device 1, e.g. spacers in the winding 4 or a cylinder around the winding 4.

The insulator 5 may be cellulose based, e.g. pressboard or wood/wood laminate, synthetic, e.g. aramid or epoxy based, and/or a laminate or composite. The insulator may e.g. comprise a fibre-resin composite of fibres, e.g. synthetic fibres such as glass fibres, in a resin matrix, e.g. comprising a curable or otherwise hardenable resin such as an epoxy or polyester resin, preferably epoxy.

Figure 2:
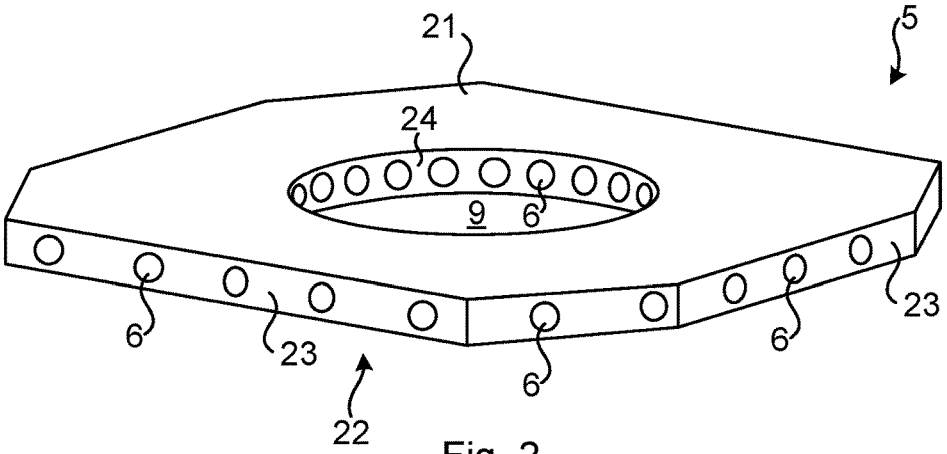
FIG. 2 is a schematic perspective view of an embodiment of an insulator in accordance with the present disclosure.

FIG. 2 illustrates an embodiment of a substantially flat insulator 5 in the having a central axial through hole 9. The flat insulator 5 has a first main surface 21, here an upper surface, and a second main surface 22, here a bottom surface, as well as an outer edge surface 23 and an inner edge surface 24 defining the through hole 9. Internal channels 6 are formed in the insulator. Each of the internal channels are configured for allowing cooling fluid 3 to enter the channel from outside of the insulator, pass though the insulator within the channel, and exit the channel to the outside of the insulator. The channels 6 may be separate from each other, or may intersect to form a network of channels. This implies that each end of each channel has an opening in one of the outer surfaces 21-24 of the insulator, or has an opening into another of the channels.

In the embodiment of FIG. 2, the internal channels 6 comprises a plurality of radial channels extending in a plane within the insulator 5, which plane is parallel to opposing first and second main surfaces 21 and 22 of the insulator. Specifically, each of the radial channels 6 extends from the outer edge surface 23, having an opening in said outer edge surface, to the inner edge surface 24, having an opening in said inner edge surface. Typically, the radial channels are separate from each other, without intersecting with each other. Typically, the radial channels are straight.

In the embodiment of FIG. 2, the internal channels 6 are bores in the insulator 5, typically formed by drilling through the insulator 5. Alternatively, in some embodiments, the channels 6 may be formed in an inner layer of a multilayer structure, e.g. a laminate. Such an inner layer may be corrugated, thus forming channels 6 there through. In some other embodiments, the inner layer may comprise spacers, e.g. in the form of discrete ribs, thus forming channels 6 there through.

Figure 3:
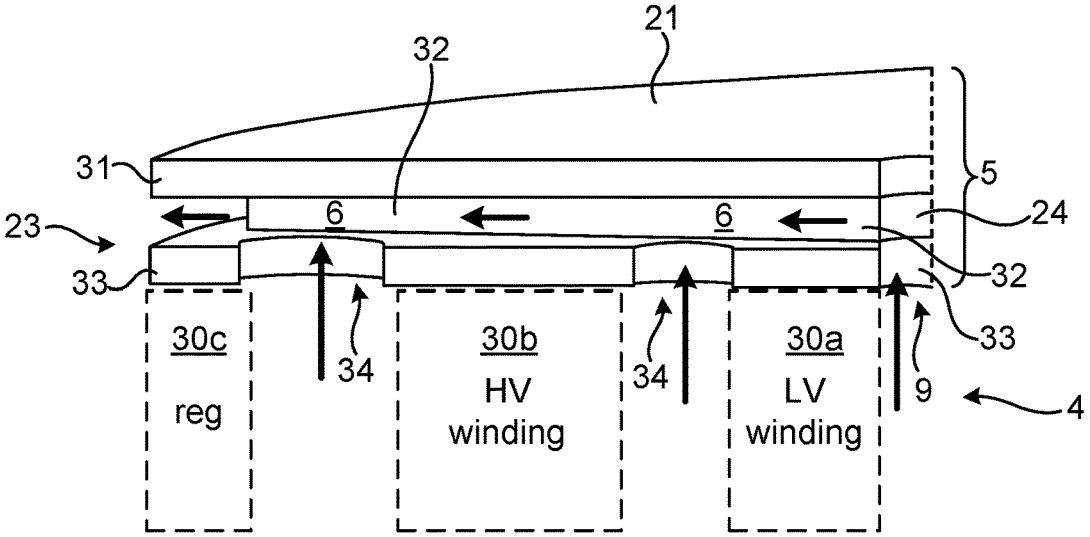
FIG. 3 is a detail of a schematic cross-sectional perspective view of an embodiment of an insulator in the form of a pressplate, in accordance with some embodiments of the present disclosure.

FIG. 3 illustrates an insulator 5 in the form of a laminate comprising an inner layer 32 formed between a first outer layer 31, having the first main surface 21 of the insulator, and a second outer layer 33, having the second main surface 22 of the insulator. The insulator 5 is in the embodiment of FIG. 3 arranged as a pressplate at one end of a winding 4, e.g. comprising a plurality of windings, in the example of the figure a low voltage (LV) winding 30*a*, a high-voltage (HV) winding 30*b* and regulation winding 30*c*. Internal radial channels 6 are formed in the inner layer 32, e.g. by the means of radial spacers arranged between the first and second outer layers 31 and 33, typically fastened (e.g. glued) to the first and second outer layers. The radial channels allow cooling fluid to flow radially within the insulator 5, outward from the axial through hole 9 (as indicated by the arrows) or vice versa.

In the embodiment of FIG. 3, the channels 6 also comprise axial channels 34, each corresponding to a hole through the second outer layer 33 which open up into a radial channel. More generally, each of the axial channels 34 extends through at least one of the first and second main surfaces 21 and 22 and into at least one of the radial channels for allowing the cooling fluid to pass between the axial and radial channels. Looking at the example embodiment of FIG. 3, cooling fluid may flow through the axial channels until they intersect with radial channels and may then continue to flow through said radial channels (as indicated by the arrows in the figure) or vice versa. Thus, if the insulator 5 is an upper pressplate, the cooling fluid may flow upwards along or within the winding 4 until the fluid reaches the insulator 5, whereby the cooling fluid enters the insulator via the axial channels 34 and/or the axial through hole 9 into the radial channels which conducts the fluid flow outwards. Thus, efficient circulation of the cooling fluid may be obtained.

Internal channels 6 may reduce the mechanical strength of the insulator 5, why it may in some embodiments be advantageous to use a fibre-resin composite material in the insulator to improve mechanical strength without increasing the thickness of the insulator. Thus, the first outer layer 31 and/or the second outer layer 33 may be made of a composite material of fibres in a resin matrix. The inner layer 32 may e.g. comprise spacers fastened (e.g. glued) to the first and second outer layers to form internal (radial) channels 6, which spacers may be of the same composite material or of another suitable material e.g. cellulose-based such as pressboard or wood. The fibres are typically electrically insulating, e.g. synthetic fibres such as glass fibres. The resin is typically a hardenable resin such as a curable or thermosetting resin, e.g. an epoxy or polyester resin, preferably an epoxy resin.

According to an embodiment of the present disclosure, an electrical insulator 5, for an inductive device 1 is filled with an electrically insulating cooling fluid 3, the insulator defining a plurality of internal channels 6 for allowing the fluid 3 to flow there through to improve circulation of the fluid within the inductive device.

In some embodiments of the present disclosure, the insulator 5 is flat and the channels 6 comprise or consist of radial channels extending in a plane within the insulator, which plane is parallel to opposing first and second main surfaces 21 and 22 of the insulator. In some embodiments, the insulator 5 has an inner edge surface 24 defining a central through hole 9 through the insulator, said through hole being perpendicular to the plane of the insulator, in which plane the radial channels 6 extend. In this case, each of the radial channels 6 may extend from an outer (outward facing) edge surface 23 of the insulator to the inner edge surface 24 of the insulator. Additionally or alternatively, in some embodiments, the channels 6 comprise axial channels 34, where each of the axial channels extends through at least one of the first and second main surfaces 21 and 22 and into at least one of the radial channels for allowing the cooling fluid to pass between the axial and radial channels (i.e. each of the axial channels has an inlet or outlet into/out from the a radial channel).

In some embodiments of the present disclosure, the insulator 5 is made of at least one electrically insulating material comprising a cellulose-based material, e.g. pressboard or wood laminate, preferably pressboard.

In some embodiments of the present disclosure, the insulator 5 is made of at least one electrically insulating material comprising a composite material of fibres, e.g. synthetic fibres such as glass fibres, in a resin matrix. The resin matrix may comprise a curable resin such as an epoxy or polyester resin, preferably epoxy.

In some embodiments of the present disclosure, the insulator 5 is a laminate wherein the channels 6 are formed by means of spacers 32 arranged between first and second outer layers 31 or 33 of the insulator. In some embodiments, the first outer layer 31 and/or the second outer layer 33 is made of a composite material of fibres, e.g. synthetic fibres such as glass fibres, in a resin matrix. The resin matrix may comprise a curable resin such as an epoxy or polyester resin, preferably epoxy. In some embodiments, the spacers 32 are formed by a continuous corrugated layer arranged between the first and second outer layers 31 or 33. In some other embodiments, the spacers 32 are formed by discrete ribs arranged between the first and second outer layers 31 or 33.

In some other embodiments of the present disclosure, the channels 6 are bores in the insulator 5, typically formed by drilling.

In some embodiments of the present disclosure, the insulator 5 is arranged as a pressplate at the top and/or bottom of the winding arrangement 4.

In some embodiments of the present disclosure, the inductive device 1 is a transformer or a reactor, preferably a transformer.

In some embodiments of the present disclosure, the cooling fluid is a liquid, e.g. a mineral oil or ester liquid, preferably a mineral oil.

Embodiments of the present disclosure may be described in any one of the following points.

1. An electrical insulator 5, for an inductive device 1 filled with an electrically insulating cooling fluid 3, the insulator defining a plurality of internal channels 6 for allowing the fluid 3 to flow there through to improve circulation of the fluid within the inductive device.
2. The insulator of point 1, wherein the insulator 5 is flat and the channels 6 comprise radial channels extending in a plane within the insulator which is parallel to opposing first and second main surfaces 21, 22 of the insulator.
3. The insulator of point 2, wherein the insulator 5 has an inner edge surface 24 defining a central through hole 9 through the insulator, perpendicular to the plane of the insulator, and wherein each of the radial channels 6 extends from an outer edge surface 23 of the insulator to the inner edge surface 24 of the insulator.
4. The insulator of point 2 or 3, wherein the channels 6 comprise axial channels 34, each of the axial channels extending through at least one of the first and second main surfaces 21, 22 and into at least one of the radial channels for allowing the cooling fluid to pass between the axial and radial channels.
5. The insulator of any preceding point, wherein the insulator 5 is made of at least one electrically insulating material comprising a cellulose-based material, e.g. pressboard or wood laminate, preferably pressboard.
6. The insulator of any preceding point, wherein the insulator 5 is made of at least one electrically insulating material comprising a composite material of fibres, e.g. synthetic fibres such as glass fibres, in a resin matrix, e.g. comprising a curable resin such as an epoxy or polyester resin, preferably epoxy.
7. The insulator of any preceding point, wherein the insulator 5 is a laminate wherein the channels 6 are formed by means of spacers 32 arranged between first and second outer layers 31, 33 of the insulator.
8. The insulator of point 7, wherein the first outer layer 31 and/or the second outer layer (33) is made of a composite material of fibres, e.g. synthetic fibres such as glass fibres, in a resin matrix, e.g. comprising a curable resin such as an epoxy or polyester resin, preferably epoxy.
9. The insulator of point 7 or 8, wherein the spacers 32 are formed by a continuous corrugated layer.
10. The insulator of point 7 or 8, wherein the spacers 32 are formed by discrete ribs.
11. The insulator of any point 1-6, wherein the channels 6 are bores in the insulator 5.
12. An inductive device 1 comprising:

a housing 2;

an electrically insulating cooling fluid 3 contained within the housing 2; a winding arrangement 4 submerged in the cooling fluid 3; and at least one insulator 5 of any preceding point.

13. The inductive device of point 12, wherein the at least one insulator 5 is arranged as a pressplate at the top and/or bottom of the winding arrangement 4.
14. The inductive device of point 12 or 13, wherein the inductive device 1 is a transformer or a reactor, preferably a transformer.
15. The inductive device of any point 12-14, wherein the cooling fluid is a liquid, e.g. a mineral oil or ester liquid.

The present disclosure has mainly been described above with reference to a few embodiments. However, as is readily appreciated by a person skilled in the art, other embodiments than the ones disclosed above are equally possible within the scope of the present disclosure, as defined by the appended claims.

The invention claimed is:

1. An electrical insulator, for an inductive device filled with an electrically insulating cooling fluid, the insulator defining a plurality of internal channels for allowing the fluid to flow there through to improve circulation of the fluid within the inductive device, wherein the insulator is flat and the internal channels comprise radial channels extending in a plane within the insulator which is parallel to opposing first and second main surfaces of the insulator, wherein the internal channels comprise axial channels, each of the axial channels extending through at least one of the first and second main surfaces and into at least one of the radial channels for allowing the cooling fluid to pass between the axial and radial channels, and wherein the insulator is made of at least one electrically insulating material comprising a composite material of fibres, wherein the fibres are synthetic fibres in a resin matrix, comprising a curable resin, wherein the insulator has an inner edge surface defining a central through hole through the insulator, perpendicular to the plane of the insulator, and wherein each of the radial channels extends from an opening in an outer edge surface of the insulator to an opening of the inner edge surface of the insulator.

2. The insulator of claim 1, wherein the insulator is made of at least one electrically insulating material comprising a cellulose-based material.

3. The insulator of claim 1, wherein the insulator is a laminate wherein the channels are formed by means of spacers arranged between first and second outer layers of the insulator.

4. The insulator of claim 3, wherein the first outer layer and/or the second outer layer is made of a composite material of fibres, wherein the fibres are synthetic fibres in a resin matrix, comprising a curable resin.

5. The insulator of claim 3, wherein the spacers are formed by a continuous corrugated layer.

6. The insulator of claim 3, wherein the spacers are formed by discrete ribs.

7. The insulator of claim 1, wherein the channels are bores in the insulator.

8. An inductive device comprising:

a housing;

an electrically insulating cooling fluid contained within the housing;

a winding arrangement submerged in the cooling fluid; and at least one insulator of claim 1.

9. The inductive device of claim 8, wherein the at least one insulator is arranged as a pressplate at the top and/or bottom of the winding arrangement.

10. The inductive device of claim 8, wherein the inductive device is a transformer or a reactor.

11. The inductive device of claim 8, wherein the cooling fluid is a liquid, optionally a mineral oil or ester liquid.

12. The insulator of claim 1, wherein the synthetic fibres comprise glass fibres.

13. The insulator of claim 1, wherein the curable resin comprises a polyester resin.

14. The insulator of claim 1, wherein the curable resin comprises an epoxy.

15. The insulator of claim 2, wherein the cellulose-based material comprises press board.

16. The insulator of claim 2, wherein the cellulose-based material comprises wood laminate.

17. The insulator of claim 4, wherein the synthetic fibres comprise glass fibres.

18. The insulator of claim 4, wherein the curable resin comprises a polyester resin.

19. The insulator of claim 4, wherein the curable resin comprises an epoxy.

20. The inductive device of claim 10, wherein the inductive device is a transformer.

* * * * *